US006353932B2

(12) United States Patent
Stembridge

(10) Patent No.: US 6,353,932 B2
(45) Date of Patent: Mar. 12, 2002

(54) MARTIAL ARTS GI WITH TARGETS

(76) Inventor: Alan I. Stembridge, 4433 Pinegrove Road, Kelowna BC (CA), V1W 1Y9

( * ) Notice: Subject to any disclaimer, the term of this patent is extended or adjusted under 35 U.S.C. 154(b) by 0 days.

(21) Appl. No.: 09/884,974

(22) Filed: Jun. 21, 2001

Related U.S. Application Data

(60) Provisional application No. 60/213,276, filed on Jun. 22, 2000.

(51) Int. Cl.[7] ..... A41C 3/01
(52) U.S. Cl. ..... 2/69; 463/8
(58) Field of Search ..... 2/69, 79, 69.5, 2/227, 228, 113–115, 95, 85, 93; 463/8, 49, 53, 54, 56; 472/133, 150, 198–200, 207, 215, 278, 476

(56) References Cited

U.S. PATENT DOCUMENTS

| | | | | |
|---|---|---|---|---|
| 3,866,909 A | | 2/1975 | DeSantis | |
| 4,453,271 A | * | 6/1984 | Donzis | 2/445 |
| 4,653,582 A | | 3/1987 | Ehrenfried | |
| 4,971,334 A | * | 11/1990 | Stewart | 473/346 |
| 4,991,231 A | | 2/1991 | Swift | |
| 5,054,127 A | * | 10/1991 | Zerchak | 2/247 |
| 5,209,691 A | * | 5/1993 | Ekstein | 446/28 |
| 5,221,092 A | * | 6/1993 | Simons, Jr. et al. | 473/349 |
| 5,411,269 A | * | 5/1995 | Thomas | 473/349 |
| 5,426,787 A | * | 6/1995 | Freeman | 2/69 |
| 5,501,649 A | | 3/1996 | Queppet | |
| 5,570,881 A | * | 11/1996 | Lau | 473/57.3 |
| 5,626,343 A | * | 5/1997 | Sanders | 473/349 |
| 5,742,939 A | * | 4/1998 | Williams | 2/69 |
| 5,826,879 A | * | 10/1998 | Spector | 473/349 |
| 5,913,727 A | * | 6/1999 | Ahdoot | 463/39 |

FOREIGN PATENT DOCUMENTS

| | | |
|---|---|---|
| CA | 2261472 | 8/1999 |
| FR | 2020761 | 1/1991 |

* cited by examiner

*Primary Examiner*—Gloria M. Hale
(74) *Attorney, Agent, or Firm*—Antony C. Edwards

(57) ABSTRACT

A martial arts Gi includes a flexible fabric garment adapted to be worn by a user, where said garment has a plurality of flexible target indicia on an outwardly exposed outer surface of said garment. The garment when so worn covers at least the torso and may cover the limbs of a user.

18 Claims, 3 Drawing Sheets

MARTIAL ARTS GI WITH TARGETS

CROSS REFERENCE TO RELATED APPLICATION

This application claims priority from U.S. Provisional Patent Application No. 60/213,276 filed Jun. 22, 2000 entitled Reversible Jujitsu Gi With Targets.

FIELD OF THE INVENTION

This invention relates to a Martial Arts Gi or practice uniform having highly visible patches or targets which will lie superimposed over the most vital points of contact on the body of the wearer. The combatants, during practice, may then accurately aim non-contact kicks and punches at these most vital points on their opponent's body so as to practice rendering their opponent incapacitated in the most efficient manner.

BACKGROUND OF THE INVENTION

In many of the martial arts, for example, jiu jitsu, karate, etc., participants prepare for engaging an opponent in unarmed combat. Such preparation often requires years of diligent training and practice in order to become effective. The participants become disciplined, coordinated and generally more physically fit and potentially lethal during repetitive exercises for example those simulating the striking attack upon an opponent or the defense to such an attack upon the participant. In that the combatants are unarmed, the combatants will each have the same areas of vulnerability inherent in the human form, all other things being equal. The successful combatant will be the one who can strike most effectively through the opponent's defenses so as to land an accurately focused forceful blow, kick or the like to vulnerable points on the opponent's body.

In the prior art of which applicant is aware, it is known to train for martial arts combat by physically striking at resilient targets which are meant to simulate striking parts of an opponent's body. It is also known to provide resilient padding for combatant's bodies so that the force from blows which are exchanged is absorbed by the padding. As an example of the former, applicant is aware of U.S. Pat. No. 4,991,231 which issued to Swift on Feb. 12, 1991 for a Karate Target Pad. As an example of the latter, applicant is aware of U.S. Pat. No. 5,501,649 which issued Mar. 26, 1996 to Queppet for a Martial Arts Training Pad and Blocking Shield.

Applicant is also aware of attempts in the prior art to provide targets on padding used for martial arts training, for example such as disclosed in U.S. Pat. No. 3,866,909 which issued to DeSantis on Feb. 18, 1975 for a Protective Garment for Karate with Force Indicating Members Thereon, and Canadian laid-open Patent Application No. 2,261,472 to Dabney, laid open Aug. 13, 1999 and entitled "Protective Target Apparatus to Aid in the Practice of Martial Arts". With respect to the DeSantis teaching, it is taught to provide a uniform for combatants engaging in full-contact karate and the like, where the uniform consists of a helmet and a torso-protective garment having a plurality of pockets mounted on the helmet and the garment at positions corresponding to vulnerable parts of the covered portions of the combatants. Inflated plastic bags are placed into the pockets so as to be ruptured upon impact by a blow of predetermined force. The ruptured plastic bag emits a noise indicating the successful strike. What is neither taught nor suggested is the use of flexible targets, such as those taught herein, which may be distributed over a uniform so as to cover many of the vulnerable points not located on the torso, and which would prove to be cumbersome to cover using the device of DeSantis.

Applicant notes that DeSantis does not suggest covering the arms and legs of the combatant with a protective garment having air-bag receiving pockets, as such would likely not prove practical and would inhibit the freedom of motion of those limbs. Contrary to the teaching of DeSantis, it is taught herein, and it is one object of the present invention to provide, a Gi which, as with conventional Gis, covers the arms and legs of the user. The Gi has positioned thereon, flexible and soft targets indicating the vulnerable spots on not only the torso, but also the limbs of the user. In the present invention, the target-bearing Gi is intended to provide a training device for non-contact training so that padding such as that taught by DeSantis is not required.

SUMMARY OF THE INVENTION

Reference to Martial Arts herein includes karate, kung-fu, tae kwon do, judo, jujitsu and the like, and is not intended to be limiting.

The kicks and punches used to achieve efficient dominance over an opponent must during practice be directed to the most vital or vulnerable points on the human body. The Gi of the present invention has highly visible indicia such as patches or targets, which provide a visual target during practice sessions for locating these vital strike points as the opponent takes evasive and counter-attacking action. The targets aid in the non-contact practicing of accurate kicks and punches to these areas. Advantageously, in one embodiment of the invention, the Gi is reversible so that a conventionally appearing Gi may be turned inside-out to expose the targets for non-contact practice.

Such targets may be mounted on or integrated with the fabric of the Gi, on one of its sides, by a number of different methods such as by dyeing, by sewing, by silk-screening or other printing methods, or by ironing on such separate targets as will have heat-activated adhesive on one side. Such targets may conform in both size and shape to the vulnerable area of the body and may be raised, textured or padded. In alternative embodiments the targets may include sensors to detect successful strikes and/or to detect the force of such strikes. The sensors may communicate such strike information electrically or otherwise for gathering, collation and processing by a remote digital processor, for example a remote laptop computer. Such information, once processed, may be used to monitor training or matches between combatants.

The targets, then, may be situated on the Gi so as to indicate the locations of the following 12 strike points: Trapezius Muscle, Triceps Muscle, Biceps Muscle, Brachioradial Muscle, Abdomen, Groin, Medial Quadriceps Muscle, Lateral Quadriceps Muscle, Medial Calf Muscle, Lateral Calf Muscle, Kidney and Axilla.

The Martial Arts Gi of the present invention is thus a garment having highly visible patches or targets attached or formed in an outer surface, where the garment may be reversible so that the targets are on one side only, that side generally being the inside reversible surface thereof. These targets are positioned on the surface of the garment so as to lie superimposed over the most vital or vulnerable points or strike zones on the body of the wearer. During practice sessions, the garment may be worn so as to expose the targets, that is, so that they are visible to an opponent. The combatants may then aim their non-contacting practice kicks and punches more accurately at these targets or strike zones so as to practice striking the most vital points of their opponent's body. By having visual target indicia for reference on the opponent during practice sessions, co-ordination and accuracy may more rapidly improve.

In summary, the martial arts Gi of the present invention includes a flexible fabric garment adapted to be worn by a user, where the garment has a plurality of flexible target indicia on an outwardly exposed outer surface of the garment. The garment when so worn covers at least the torso and may cover the limbs of a user.

The target indicia are positioned on the garment so as to correspond to the position of vulnerable target areas on the user when wearing the garment. Vulnerable target areas means areas on the user which are vulnerable to forceful impacts such as kicks or punches.

Where the garment covers the limbs of the user, the target indicia include target indicia on the limb-covering portions of the garment so as to correspond to vulnerable target areas on the limbs of the user.

In one embodiment the garment is reversible. For example, the garment may comprise a jacket and a pair of pants. The target indicia may be sized and shaped to represent the size and shape of the corresponding vulnerable target areas of the user. For example, the target indicia may be fabric patches which are each generally round or obround and mounted to the garment so as to lie flush. The target indicia are preferably indicated by means for contrasting the indicia from the garment, for example by contrasting markings, color, texture, padding or appearance generally. The target indicia may include strike sensors.

DETAILED DESCRIPTION OF EMBODIMENTS OF THE INVENTION

Figure 1:
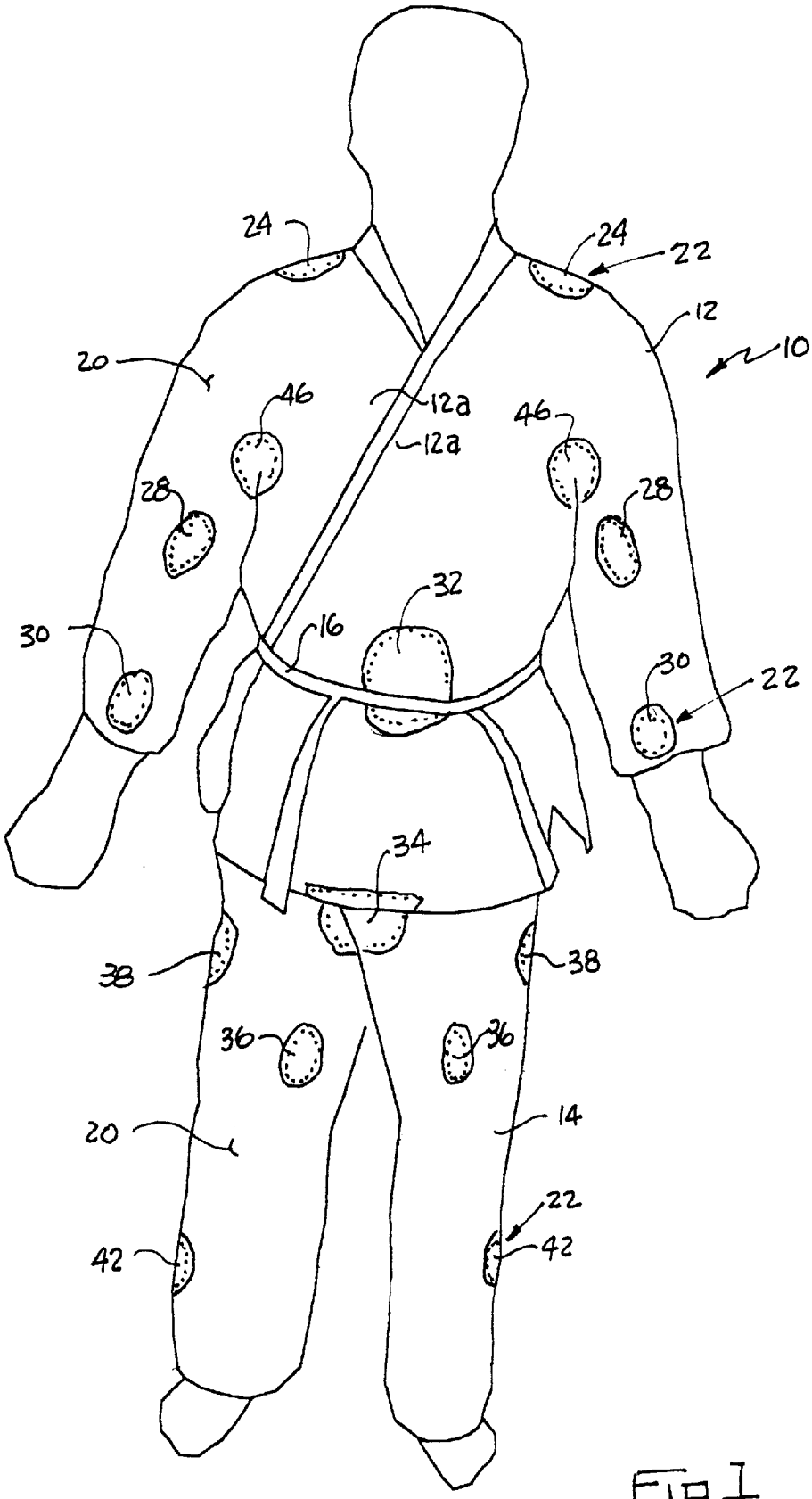
FIG. 1 is a front view of a person wearing a Gi according to the present invention, illustrating the position of the strike zone targets.
Figure 2:
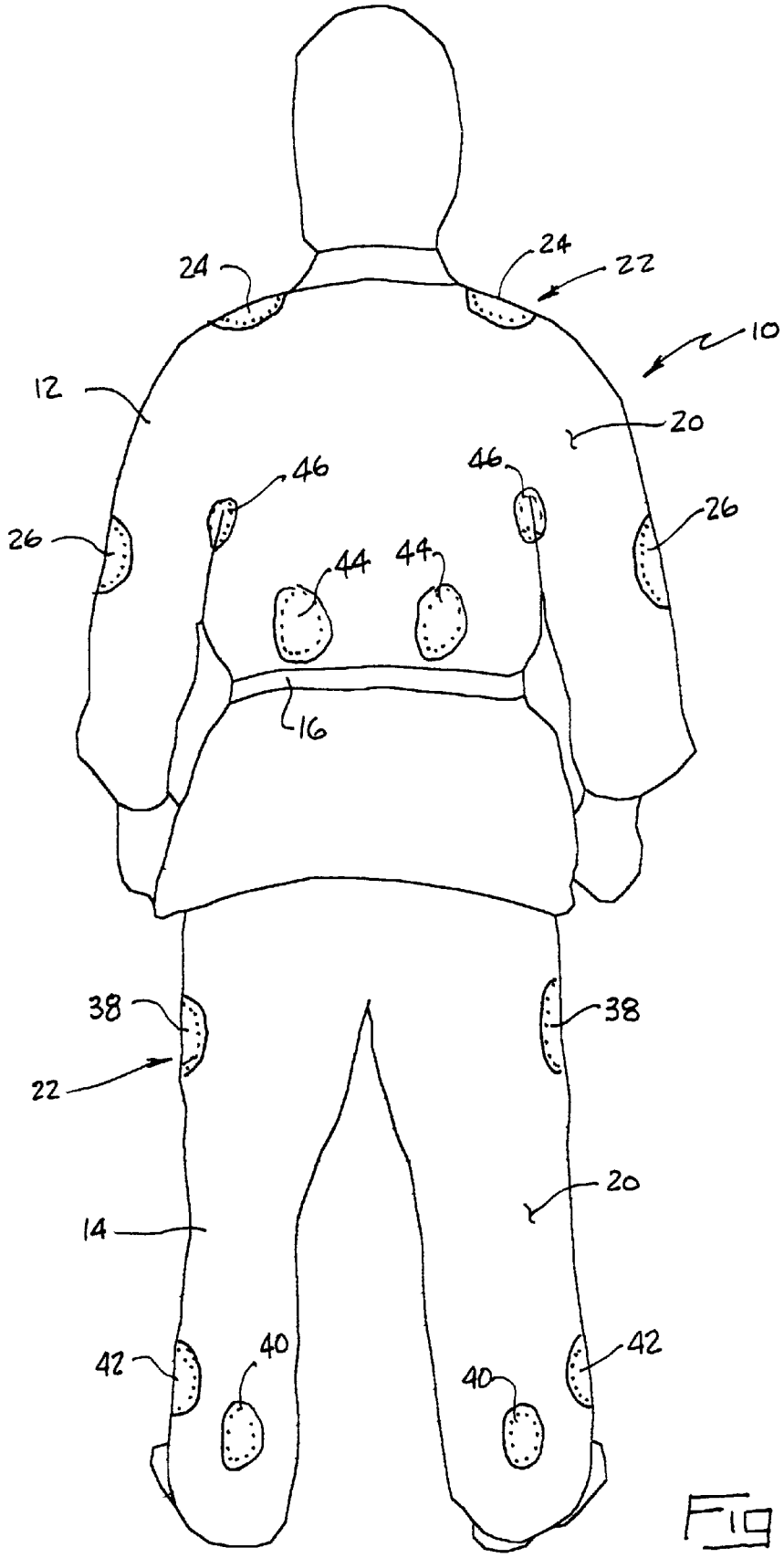
FIG. 2 is a rear view of a person wearing a Gi according to the present invention, illustrating the position of the strike zone targets.

As seen in the accompanying figures, the Martial Arts Gi or practice uniform 10 of the present invention is manufactured for example from a sturdy heavy grade cotton fabric so as to resist rips and tears during use. The Gi may generally comprise a separate jacket 12 and trousers 14. The jacket has overlapping front panels 12*a* which are retained in a closed position by a fabric belt 16. The Gi of the present invention has a reversible embodiment. In this embodiment, not intended to be limiting, when practice uniform or Gi 10 is worn in its reversed position, i.e. turned inside-out as viewed in FIGS. 1 and 2, the interior surface of the Gi is exposed.

The interior surface 20 has positioned thereon target indicia 22 indicating targets or strike zones. Target indicia 22 may be attached to the fabric of the interior surface 20 of Gi 10 in any one of several suitable ways, such as by sewing, adhesive, or the like, or may be formed, printed or dyed onto the fabric. Target indicia 22 are superimposed over the most vital or vulnerable points on the body. The target indicia may be brightly coloured or otherwise adapted to contrast against Gi 10 and may generally conform in both size and shape to the corresponding target area of the body, which when accurately impacted with the requisite force, will disable the opponent.

Figure 3:
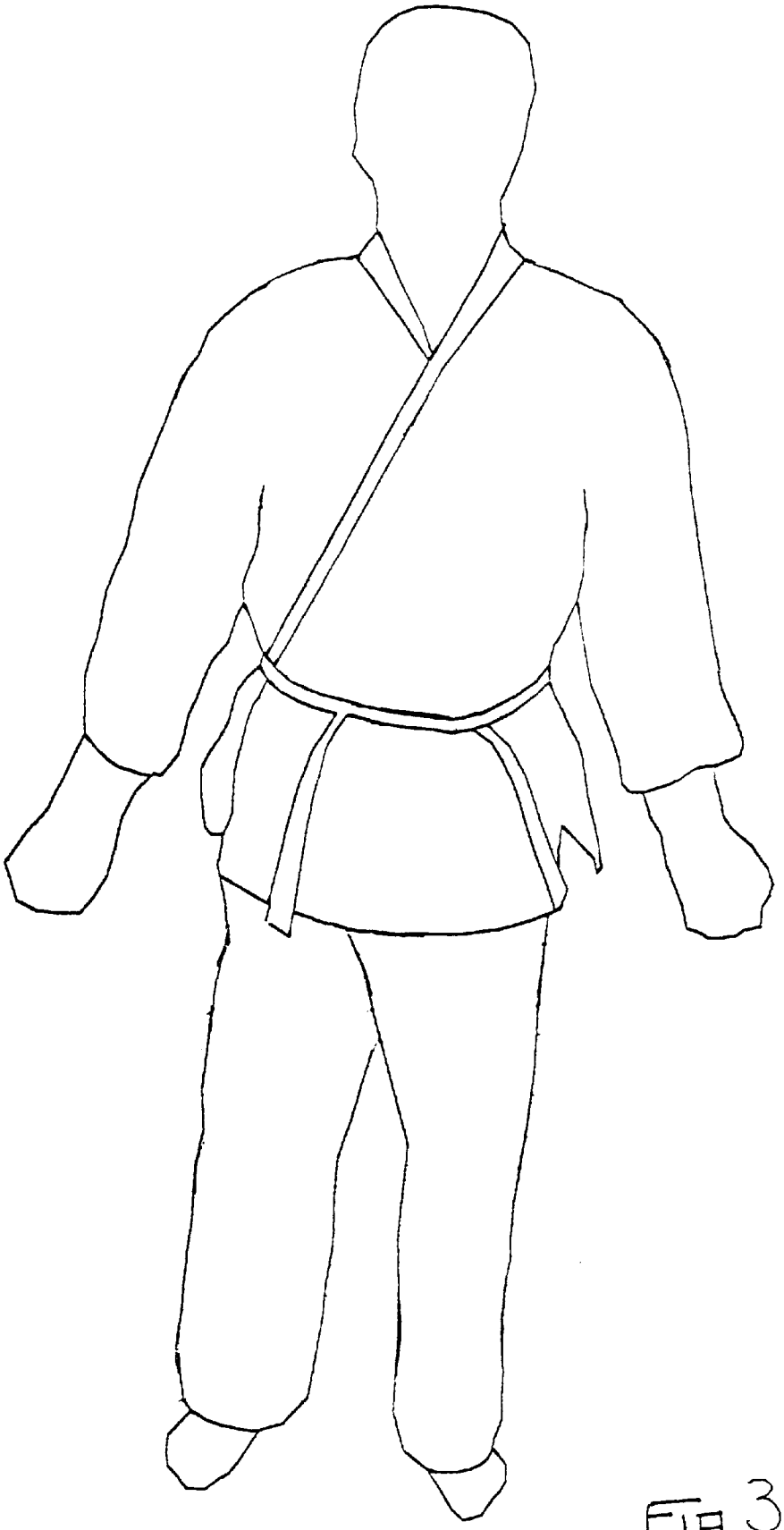
FIG. 3 is a front view of a person wearing a reversible Gi according to the present invention with the Gi reversed to appear as a conventional Gi.

The Gi may be reversed back to a conventional appearing Gi such as seen in FIG. 3 by once again turning the garment inside-out. In other embodiments the Gi may not be reversible, or may have different target patterns or differently sized targets depending on which side of the reversible Gi is exposed.

The vital points of contact on the body over which, typically, strike zone targets may be superimposed are as follows: targets 24 are located over the trapezius muscles, targets 26 identify the triceps muscle, targets 28 identify the biceps muscle, targets 30 identify the brachioradial muscle, target 32 identifies the abdomen, target 34 identifies the groin, targets 36 identify the medial quadriceps muscle, targets 38 identify the lateral quadriceps muscle, targets 40 identify the medial calf muscle, targets 42 identify the lateral calf muscle, targets 44 identify the kidneys and targets 46 identify the axilla.

As will be apparent to those skilled in the art in the light of the foregoing disclosure, many alterations and modifications are possible in the practice of this invention without departing from the spirit or scope thereof.

What is claimed is:

1. A martial arts Gi comprising a flexible fabric garment adapted to be worn by a user, said garment when so worn covering at least a torso and limbs of a user, said garment having a plurality of flexible target indicia on an outwardly exposed outer surface of said garment, said target indicia positioned on said garment so as to correspond to the position of vulnerable target areas on said user when wearing said garment, said vulnerable target areas on said user vulnerable to forceful impacts, said target indicia including target indicia on limb-covering portion of said garment so as to correspond to vulnerable areas of said vulnerable target areas on said limbs of said user.

2. The Gi of claim 1 wherein said garment is reversible.

3. The Gi of claim 1 wherein said garment comprises a jacket and a pair of pants.

4. The Gi of claim 1 wherein said target indicia are sized and shaped to represent the size and shape of the corresponding said vulnerable target areas of said user.

5. The Gi of claim 1 wherein said target indicia are fabric patches mounted to said garment so as to lie flush against said garment.

6. The Gi of claim 5 wherein said target indicia are each generally round or obround.

7. The Gi of claim 1 wherein said target indicia are indicated by means for contrasting said indicia from said garment.

8. The Gi of claim 2 wherein said garment comprises a jacket and a pair of pants.

9. The Gi of claim 2 wherein said target indicia are sized and shaped to represent the size and shape of the corresponding said vulnerable target areas of said user.

10. The Gi of claim 2 wherein said target indicia are fabric patches mounted to said garment so as to lie flush against said garment.

11. The Gi of claim 10 wherein said target indicia are each generally round or obround.

12. The Gi of claim 2 wherein said target indicia are indicated by means for contrasting said indicia from said garment.

13. A martial arts Gi comprising a flexible fabric garment adapted to be worn by a user, said garment when so worn covering at least a torso of a user, said garment having a plurality of flexible target indicia on an outwardly exposed outer surface of said garment, said target indicia positioned on said garment so as to correspond to the position of vulnerable target areas on said user when wearing said garment, said vulnerable target areas on said user vulnerable to forceful impacts, and wherein said garment is reversible.

14. The Gi of claim 13 wherein said garment comprises a jacket and a pair of pants.

15. The Gi of claim 13 wherein said target indicia are sized and shaped to represent the size and shape of the corresponding said vulnerable target areas of said user.

16. The Gi of claim 13 wherein said target indicia are fabric patches mounted to said garment so as to lie flush against said garment.

17. The Gi of claim 16 wherein said target indicia are each generally round or obround.

18. The Gi of claim 13 wherein said target indicia are indicated by means for contrasting said indicia from said garment.

* * * * *